US006949031B2

(12) United States Patent
Imamoto et al.

(10) Patent No.: US 6,949,031 B2
(45) Date of Patent: Sep. 27, 2005

(54) GOLF CLUB HEAD

(75) Inventors: Yasunori Imamoto, Tokyo (JP); Hideo Matsunaga, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/759,223

(22) Filed: Jan. 20, 2004

(65) Prior Publication Data

US 2005/0003904 A1 Jan. 6, 2005

(30) Foreign Application Priority Data

Jan. 20, 2003 (JP) ..... P.2003-011267

(51) Int. Cl.[7] ..... A63B 53/04
(52) U.S. Cl. ..... 473/329; 473/345; 473/349
(58) Field of Search ..... 473/324–350, 473/290–291; D21/733–735, 753, 759

(56) References Cited

U.S. PATENT DOCUMENTS 4,438,931 A * 3/1984 Motomiya ..... 473/346
5,205,560 A 4/1993 Hoshi et al.
5,255,913 A 10/1993 Tsuchida
5,261,664 A * 11/1993 Anderson ..... 473/342
5,346,217 A 9/1994 Tsuchiya et al.
5,533,729 A * 7/1996 Leu ..... 473/346
5,755,627 A 5/1998 Yamazaki et al.
5,967,904 A * 10/1999 Nagai et al. ..... 473/345
6,071,200 A * 6/2000 Song ..... 473/345
6,162,130 A * 12/2000 Masumoto et al. ..... 473/324
6,280,349 B1 * 8/2001 Cook ..... 473/345
6,334,817 B1 * 1/2002 Ezawa et al. ..... 473/324
6,645,086 B1 * 11/2003 Chen ..... 473/335
2002/0091015 A1 * 7/2002 Seki et al. ..... 473/345

FOREIGN PATENT DOCUMENTS

JP 2002-119625 A 4/2002

* cited by examiner

*Primary Examiner*—Sebastiano Passaniti
(74) *Attorney, Agent, or Firm*—Sughrue Mion, PLLC

(57) ABSTRACT

A metal hollow golf club head includes a head main body, a top plate, and a face plate. The head main body includes both side edges and a rear edge of the crown portion, both side edges of a face portion, and a side portion formed integrally therewith. The top plate includes a crown main portion, which is a member of the crown portion other than the both side edges and rear edge of the crown portion, and an upper edge of the face portion integrally. The face plate includes a face main portion, which is a member of the face portion other than the both side edges and upper edge of the face portion. The head main body, the top plate, and the face plate are coupled. A metal material of the top plate has a longitudinal elastic modulus lower than the metal materials of the head main body and face plate.

10 Claims, 3 Drawing Sheets

GOLF CLUB HEAD

BACKGROUND OF THE INVENTION

1. Field of the Invention

The present invention relates to a hollow golf club head made from metal, and particularly relates to a golf club head having a wood type shape or another shape close to the wood type shape.

2. Description of the Related Art

Hollow golf club heads made from metal are used broadly as wood type golf club heads such as drivers or fairway woods. Generally, as shown in FIG. 4, a wood type hollow golf club head 1 includes a face portion 2 for hitting a ball therewith, a crown portion 3 forming the top portion of the golf club head, a sole portion 4 forming the bottom portion of the golf club head, a side portion 5 forming the side portion on the toe side, back side and heel side of the golf club head, and a hosel portion 6. A shaft 7 is inserted into the hosel portion 6 of the golf club head 1, and fixed thereto by an adhesive agent or the like. Incidentally, recently, many golf club heads called utility golf club heads have appeared on the market. As one kind of utility golf club head, various golf club heads similar to the wood type golf club head (that is, including a face portion, a sole portion, a side portion and a crown portion) are available on the market.

Aluminum alloys, stainless steel or titanium alloys are available as metal for forming such hollow golf club heads. Of them, titanium alloys have been used broadly in recent years.

JP-A-2002-119625 discloses a golf club head in which a face portion is made thicker than a crown portion, the crown portion is curved upward, and the face portion and the crown portion are molded integrally by press working.

In order to increase the carry of a shot with a metal hollow golf club head, development has been made and aimed at increasing the repulsion of a ball by use of bending of the face surface, to thereby hit the ball farther. However, when a golfer having a low head speed uses such a golf club head, the deformation of the face surface is so small that the effect of increasing the initial velocity of a ball is insufficient. In addition, a low trajectory of the ball may hinder increase of the carry.

According to the golf club head disclosed in JP-A-2002-119625, the crown portion is bent upward at the time when a ball is hit, so that the repulsion of the ball is enhanced. However, the face portion and the crown portion different in thickness are pressed integrally in the golf club head disclosed in JP-A-2002-119625. Such press working on members different in thickness requires a high degree of difficulty in working in view of working technology. Thus, the efficiency in manufacturing the golf club head is lowered.

SUMMARY OF THE INVENTION

It is an object of the invention to provide a golf club head easily manufactured while the carry can be increased due to increase in launch angle even when a golfer having a low head speed uses the golf club head.

According to an embodiment of the invention, a metal hollow golf club head includes a head main body, a top plate, and face plate. The head main body includes both side edges of a crown portion, a rear edge of the crown portion, both side edges of a face portion, and a side portion formed integrally therewith. The top plate includes a crown main portion, which is a member of the crown portion other than the both side edges of the crown portion and the rear edge of the crown portion, and an upper edge of the face portion formed integrally therewith. The face plate includes a face main portion, which is a member of the face portion other than the both side edges of the face portion and the upper edge of the face portion. The head main body, the top plate, and the face plate are coupled to each other. A metal material of the top plate has a longitudinal elastic modulus lower than that of the metal material of the head main body and the metal material of the face plate.

In the golf club head configured as described above, the longitudinal elastic modulus of the crown portion is made smaller than that of any other member including the sole portion, to increase the launch angle of a ball at the time of impact. As a result, even when a golfer having a low head speed uses the golf head club, the launch angle is increased so that the carry can be increased. As a result even when a golfer having a low head speed uses the golf head club, the launch angle is increased so that the carry can be increased.

In the embodiment of the invention, a major part of the face portion is formed out of a face plate. The face plate and a top plate are coupled to each other by welding or the like near the upper portion of the face portion. Generally, the hardness of a metal material increases due to welding. However, the welded seam between the top plate and the face plate is located to be lower than the uppermost edge of the face portion (the corner edge-between the face portion and the crown portion).

As a result, the vicinity of the uppermost edge of the face portion of the top plate does not suffer hardening due to the welding. Thus, the crown portion and the vicinity of the uppermost edge of the face portion, which are made from the thin top plate, are bent easily when a ball is hit. Accordingly, the golf club head has a high repulsive property so that the carry increases.

In addition, in the golf club head according to the invention, the region from the crown main portion to the upper edge of the face portion is formed out of an integrated top plate, while the face main portion is formed out of an integrated face plate. The top plate and the face plate can be produced separately. Thus, the face plate and the top place can be produced easily even when the face plate is made thicker than the top plate.

According to the embodiment of the invention, it is preferable that the head main body is formed by casting; that the top plate is formed by one of forging and press molding; and that the face plate is formed by one of casting, forging, and press molding. In such a manner, a metal material having longitudinal elastic modulus suitable to each part can be selected as the metal material for forming the part, and a method for manufacturing each part can be adopted.

In the head body, the toe side, the back side and the heel side may be formed continuously and integrally. Alternatively, the head body may be divided into two or three or more parts, which parts can be molded separately.

The golf club head according to the embodiment of the invention typically has a hosel portion. Preferably the hosel portion is molded integrally with the head body.

According to the embodiment of the invention, it is preferable that the top plate has thickness in a range of 0.5 mm to 1.2 mm. In this case, it is also preferable that the head main body is larger in thickness than the top plate by 0.2 mm to 3.0 mm; and that the face plate is lager in thickness than the top plate by 1.0 mm to 2.5 mm.

According to the embodiment of the invention, it is preferable that the head main body, the top plate, and the face plate includes at least one of titanium and titanium alloy; that the top plate has the longitudinal elastic modulus equal to or lower than 10,500 kgf/mm2 (102.9×109 Pa); and that the head main body has the longitudinal elastic modulus equal to or greater than 11,000 kgf/mm2 (107.8×109 Pa). Also, it is preferable that a difference between the top plate and the head main body in the longitudinal elastic modulus is in a range of 1,000 kgf/mm2 to 3,000 kgf/mm2 (9.8×109 Pa to 29.4×109 Pa).

The embodiment of the invention is particularly suitably applied to a large-size golf club head whose volume exceeds 250 cc, particularly 300 cc, more particularly 350 cc. A driver can be shown as such a golf club head by way of example. However, the invention is also applicable to fairway wood golf club heads, utility golf club heads similar to wood type ones, and so on.

DETAILED DESCRIPTION OF THE PREFERRED EMBODIMENT

Figure 1A:
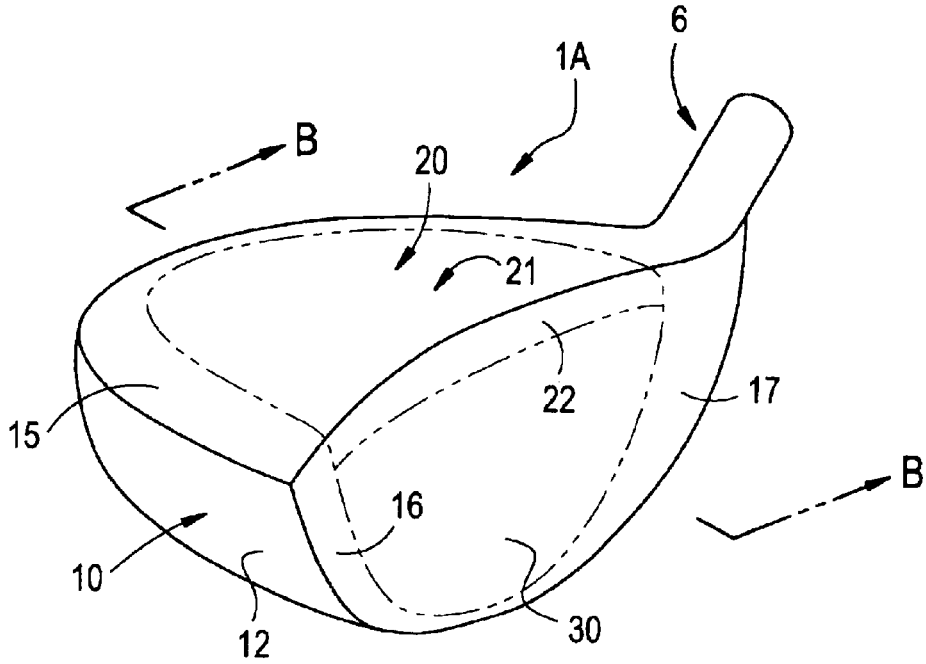
FIG. 1(*a*) is a perspective view of a golf club head according to an embodiment of the invention, and FIG. 1(*b*) is a sectional view taken along line B—B in FIG. 1(*a*).
Figure 1B:
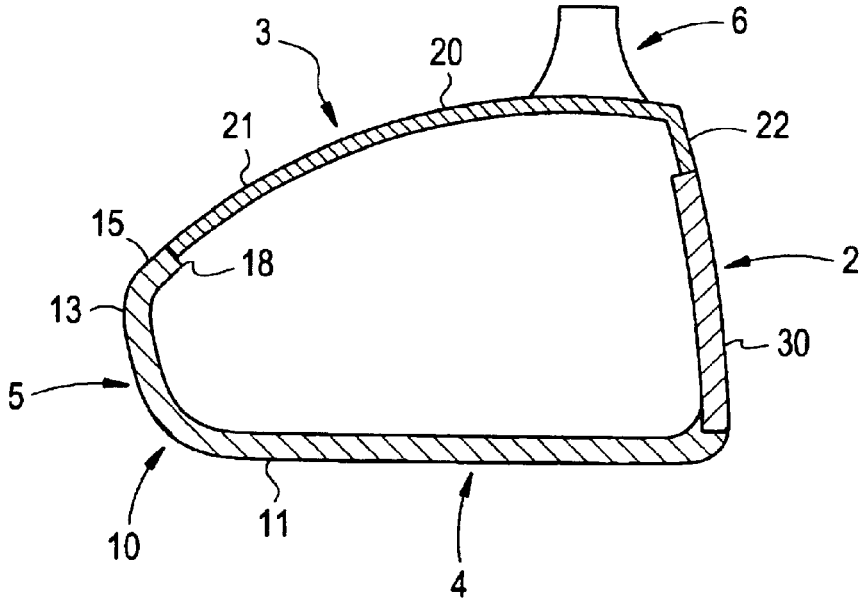
Figure 2:
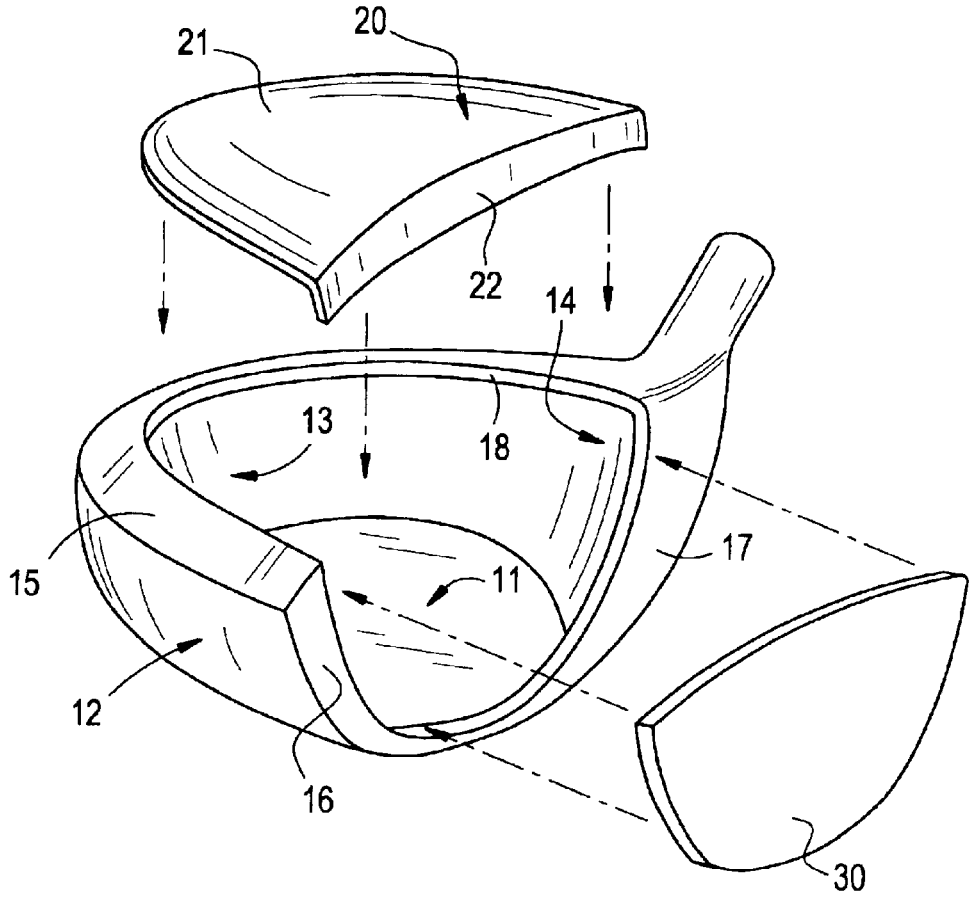
FIG. 2 is an exploded perspective view of the golf club head according to the embodiment.

Embodiments of the invention will be described below with reference to the drawings. FIGS. 1(*a*) and 1(*b*) are a perspective view and a sectional view of a golf club head according to the embodiment. FIG. 2 is an exploded perspective view of the golf club head.

A golf club head 1A includes a face portion 2, a crown portion 3, a sole portion 4, a side portion 5 and a hosel portion 6. The golf club head 1A is formed out of a head body 10, a top plate 20 and a face plate 30 integrated by welding such as laser welding or plasma welding. Incidentally, plasma welding or laser welding is high in energy density, and deep in melting-in in comparison with TIG welding. Thus, accurate and nice-looking welding can be expected.

As is shown clearly in FIG. 2, the head body 10 includes a bottom surface 11 forming the sole portion 4, a toe erected surface 12, a back erected surface 13, a heel erected surface 14, which form the side portion 5, a crown flange 15, which projects from upper edges of the erected surfaces 12 to 14 toward the crown portion 3, a toe flange 16 and a heel flange 17, which project from the toe erected surface 12 and the heel erected surface 14 respectively in the face portion 2. An opening 18 is made to range from the center of the crown portion 3 to a major part of the face portion 2. The hosel portion 6 is provided integrally with the head body 10.

The top plate 20 includes a crown plate 21, which forms a crown main portion excluding the opposite side edges on the toe side and the heel side and the rear edge in the crown portion 3, and a top plate 21, which forms the upper edge (excluding the toe flange 16 and the heel flange 17) of the face portion 2. The crown plate 21 is bent to be convex upward. The top flange is provided to extend vertically down from the front edge of the crown plate 21.

The face plate 30 forms a region (face main portion) of the face portion 2 excluding the respective flanges 16, 17 and 22.

The head body 10, the top plate 20 and the face plate 30 are welded integrally to form a golf club head. The hosel portion 6 may be provided to reach the sole portion 4, or may be provided not to reach the sole portion 4. After the welding, various finishing processes of polishing, painting and the like are performed in accordance with necessity. Thus, a product of a golf club head is obtained.

The head body 10 is a casting, which can be manufactured more easily than any other plate 20, 30 even if the head body 10 has a complicated shape.

The top plate 20 has a uniform thickness ranging from the crown plate 21 to the top flange 22. The top plate 20 is formed by forging or press molding. Since the top plate 20 has a uniform thickness throughout and has a comparative simple, substantially L-shape, the top plate 20 can be formed easily by forging or press molding.

The face plate 30 can be formed by any one of casting, forging and press molding. The face plate 30 is provided with grooves (scorelines) in accordance with necessity.

Incidentally, it is preferable that the extending width of the top flange 15 extending toward the center of the crown portion is 6–9 mm, particularly about 7–8 mm.

In the upper portion of the face portion, the lateral width of the toe flange 16 and the lateral width of the heel flange 17 are preferably equal to the extending width of the top flange 15.

Each of the toe flange 16 and the heel flange 17 may have a uniform lateral width until reaching the lower portion of the face portion. It is, however, preferable that each flange 16, 17 has a lateral width reduced gradually as approaching the lower portion of the face portion.

It is preferable that an area ratio of the crown plate 21 of the top plate 20 to the crown portion 3 is 60–90%, particularly about 65–85%.

It is preferable that the vertical width of the top flange 22 is 6–9 mm, particularly about 7–8 mm.

It is preferable that an area ratio of the face plate 30 to the face portion 2 is 60–90%, particularly 70–85%.

It is preferable that the thickness of the top plate 20 is 0.5–1.2 mm, particularly about 0.7–1.0 mm. It is preferable that the thickness of the head body 10 is 0.6–3.0 mm, particularly about 0.8–1.2 mm. It is preferable that the thickness of the face plate 30 is 1.5–3.7 mm, particularly about 2.2–3.0 mm. It is preferable that the head body 10 is 0.2–3.0 mm thicker, particularly 0.5–2.5 mm thicker than the top plate 20. It is preferable that the face plate 30 is 1.0–2.5 mm thicker, particularly 1.3–2.0 mm thicker than the top plate 20.

In this embodiment, each of the head body 10, the top plate 20 and the face plate 30 is made from titanium or a titanium alloy. The longitudinal elastic modulus of the top plate 20 is lower than that of any other portion, that is, each of the head body 10 and the face plate 30.

Since the longitudinal elastic modulus of the top plate 20 occupying a major part of the crown portion is made low in such a manner, the launch angle of a ball at the time of impact is high. Accordingly, even if a golfer having a low head speed uses the golf club head, a long carry can be obtained.

Incidentally, when the difference in longitudinal elastic modulus between the crown portion and the sole portion is equal to or greater than 1,000 kgf/mm$^2$ ($9.8\times10^9$ Pa), particularly equal to or greater than 1,500 kgf/mm$^2$ ($14.7\times10^9$ Pa), the crown portion is bent more easily, so that a longer carry can be obtained. Incidentally, when the difference in longitudinal elastic modulus between the crown portion and the sole portion is too large, the launch angle is indeed high, but the repulsive force of a ball when the ball is hit is reduced, so that the carry is reduced. It is therefore usually preferable that the difference is equal to or lower than 3,000 kgf/mm$^2$ ($29.4\times10^9$ Pa), particularly equal to or lower than 2,600 kgf/mm$^2$ ($24.5\times10^9$ Pa).

In this embodiment, a major part of the face portion 2 is formed out of the face plate 30, and the face plate 30 and the top flange 22 are welded in the upper edge portion of the face portion 2. Generally the hardness of a metal material increases due to welding. However, the welded seam between the top flange 22 and the face plate 30 is located to be lower than the uppermost edge of the face portion 2 (the corner edge between the face portion 2 and the crown portion 3).

As a result, the crown plate 20 and the vicinity of the uppermost edge of the face portion do not suffer hardening due to the welding. Thus, the crown plate 20 and the vicinity of the uppermost edge of the face portion, which are thin, are bent easily when a ball is hit. Accordingly, the golf club head has a high repulsive property so that the carry increases.

Next, description will be made on metal materials forming the golf club head.

As the titanium alloy for the top plate 20, β type titanium alloy whose longitudinal elastic modulus is not higher than 10,500 kgf/mm$^2$ ($102.9\times10^9$ Pa) is preferable. Examples of such titanium alloys include Ti-15V-3Cr-3Sn-3Al, Ti-13V-11Cr-3Al, Ti-15Mo-5Zr, Ti-15Mo-5Zr-3Al, Ti-3Al-8V-6Cr-4Mo-4Zr, and Ti-22V-4Al.

As the material of the face plate 30, either the aforementioned β type titanium alloy or an α-β type titanium alloy which will be described later may be used.

As the material of the head body 10, a titanium alloy whose longitudinal elastic modulus is not lower than 11,000 kgf/mm$^2$ ($107.8\times10^9$ Pa) is preferable. Examples of such titanium alloys include Ti-6Al-4V and Ti-6Al-6V-2Sn which are α-β type titanium alloys, and Ti-8Al-1Mo-1V which is a near α type titanium alloy. In addition, Ti-3Al-8V-6Cr-4Mo-4Zr and Ti-22V-4Al, which are β type titanium alloys heat-treated to have a longitudinal elastic modulus within the aforementioned range can be also used.

Generally, the longitudinal elastic modulus of a β type titanium alloy varies in accordance with a difference in a heat treatment mode. The following Table 1 shows treatment modes and longitudinal elastic moduli of various titanium alloys and pure titanium.

TABLE 1

| crystal structure | titanium alloy | longitudinal elastic modulus (kg/mm$^2$) | purpose | preferred applicable part |
|---|---|---|---|---|
| β | Ti—15V—3Cr—3Sn—3Al | 10,200–10,500 | forging | crown member |
| β | Ti—13V—11Cr—3Al | 8,400–10,500 | forging | crown member |
| β | Ti—15Mo—5Zr | 7,800–12,000 | forging | crown member |
| β | Ti—15Mo—5Zr—3Al | 8,000–12,000 | forging | crown member |
| β | Ti—3Al—8V—6Cr—4Mo—4Zr | 10,700–12,600 | forging | crown member |
| β | Ti—22V—4Al | 8,900–11,000 | forging | crown member |
| α–β | Ti—6Al—4V | 11,500 | forging/ casting | sole member |
| α–β | Ti—6Al—6V—2Sn | 11,300 | | sole member |
| near α | Ti—8Al—1Mo—1V | 12,700 | forging | sole member |
| | pure titanium | 10,850 | | hosel member |
| α–β | Ti—3Al—2V (+S + rare earth) | 10,900 | | hosel member |

Incidentally, in the heat treatment of the β type titanium alloy, it is preferable that age-hardening treatment is not performed on the material used for the top plate. Thus, the elastic modulate of the material is kept low. Also as the material of the head body 10, β type titanium alloy subjected to age-hardening treatment may be used.

Next, description will be made on preferred dimensions of each part of the golf club head.

The invention is applied particularly effectively to a large-size golf club head whose crown portion is bent easily, and whose head volume is specifically not smaller than 250 cc, preferably not smaller than 300 cc, more preferably not smaller than 350 cc. Generally, the larger the volume of a golf club head is, the larger the weight of the golf club head is. When the weight is too large, it is difficult to swing a golf club with the golf club head smoothly. From the point of view of this restriction on weight, it can be therefore considered that the head volume has an upper limit in about 600 cc. The invention is suitable for application to a driver head whose loft angle is 7°–15°.

It is preferable that the face height of the golf club head is higher. The higher the face height is, the larger the loft angle is when a ball is hit with an upper portion of the face surface. Specifically, it is preferable that the face maximum height is not smaller than 45 mm, particularly not smaller than 50 mm, more particularly not smaller than 53 mm. However, it is not preferable that the face height reaches 100 mm or more. In such a case, the wind pressure resistance of the face surface during a swing increases excessively.

When the golf club head is used as a driver head, the club length is typically about 43–50 inches. In consideration of swing balance, it is preferable that the head weight is about 165–205 g. When the golf club head is too heavy, a general golfer is out of balance during a swing so that the golfer cannot take a full swing. When the head is too light, the repulsion of a ball may deteriorate.

Figure 3A:
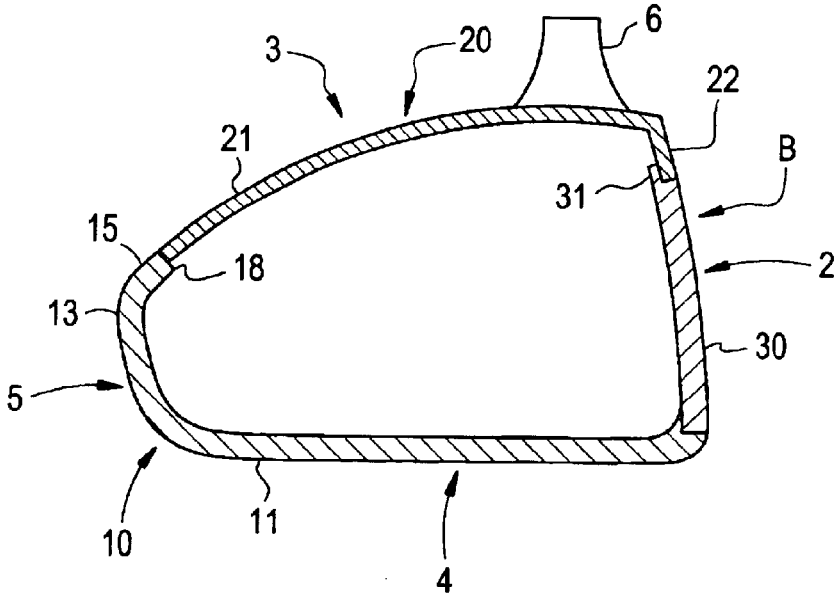
FIG. 3(*a*) is a longitudinally sectional view of a golf club head according to another embodiment of the invention, and FIG. 3(*b*) is an enlarged view of the vicinity of a point B in FIG. 3(*a*).
Figure 3B:
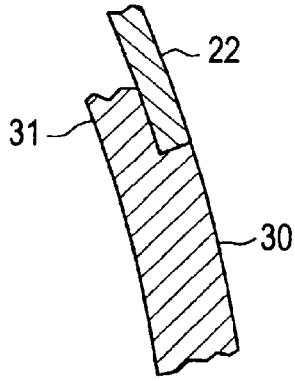
Figure 4:
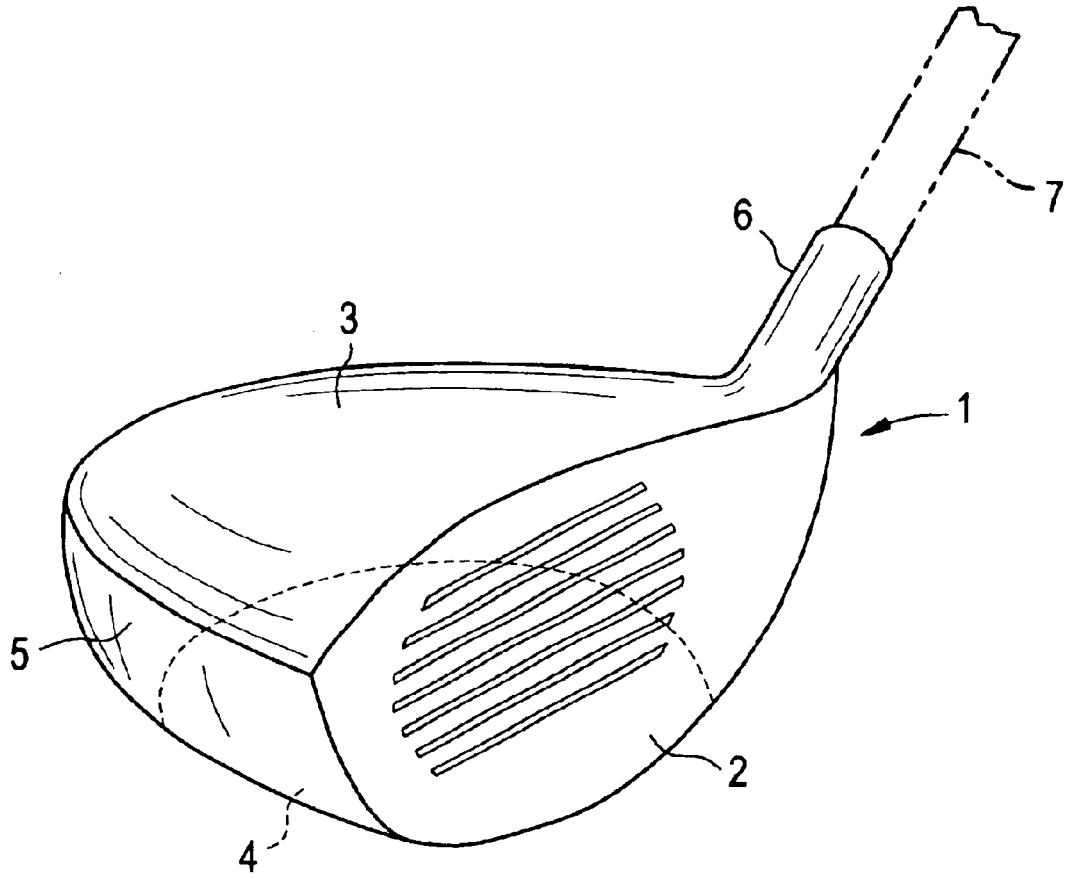
FIG. 4 is a perspective view of a conventional golf club head.

In the invention, as shown in FIGS. 3(*a*) and 3(*b*), a standing piece 31 may be provided to extend upward from the upper edge of the face plate 30 so as to follow the back surface of the lower edge of the top flange 22. In such a configuration, the standing piece 31 can backup the top flange 22 in the case of a pop-fly shot when a ball is hit near the upper edge of the face portion 2. Incidentally, the standing piece 31 may be coupled to the top flange 22 by welding or the like, or may be merely brought into contact with the top flange 22. Alternatively, there may be a slight gap (for example, not larger than 0.3 mm) between the standing piece and the top flange 22.

In the invention, a bottom flange (not shown) forming the loser edge of the face portion 2 may be provided in the head body 10 so as to extend upward from the sole portion 4. In this case, the face plate 30 is welded with the bottom flange.

As described above, even when a golfer having a low head speed uses the golf club head according to the invention, the launch angle becomes so high that the carry can be increased. The golf club head is also manufactured easily.

What is claimed is:

1. A metal hollow golf club head comprising:

a head main body including both side edges of a crown portion, a rear edge of the crown portion, both side edges of a face portion, and a side portion formed integrally therewith;

a top plate including a crown main portion, which is a member of the crown portion other than the both side edges of the crown portion and the rear edge of the crown portion, and an upper edge of the face portion formed integrally therewith; and a face plate including a face main portion, which is a member of the face portion other than the both side edges of the face portion and the upper edge of the face portion, wherein:

the head main body, the top plate, and the face plate are coupled to each other; and the metal material of the top plate has a longitudinal elastic modulus lower than that of metal material of the head main body and metal material of the face plate.

2. The golf club head according to claim 1, wherein:

the head main body is formed by casting;

the top plate is formed by one of forging and press molding; and the face plate is formed by one of casting, forging, and press molding.

3. The golf club head according to claim 1, wherein:

the top plate has a thickness in a range of 0.5 mm to 1.2 mm;

the head main body is larger in thickness than the top plate by 0.2 mm to 3.0 mm; and the face plate is larger in thickness than the top plate by 1.0 mm to 2.5 mm.

4. The golf club head according to claim 1, wherein the head main body, the top plate, and the face plate are welded to one another.

5. Th golf club head according to claim 1, wherein the upper edge of the face portion has a width in a vertical direction in a range of 6 mm to 9 mm.

6. The golf club head according to claim 1, wherein a ratio of th area of the face plate to the area of the face portion is in a range of 60% to 90%.

7. The golf club head according to claim 1, wherein a ratio of the area of the top plate to the area of the crown portion is in a range of 30% to 80%.

8. The golf club head according to claim 1, wherein:

the head main body, the top plate, and the face plate includes at least one of titanium and titanium alloy;

the top plate has a longitudinal elastic modulus equal to or lower than 10,500 kgf/mm2; and the head main body has a longitudinal elastic modulus equal to or greater than 11,000 kgf/mm2.

9. The golf club head according to claim 8, wherein a difference between the top plate and the head main body in the longitudinal elastic modulus is in a range of 1,000 kgf/mm2 to 3,000 kgf/mm2.

10. Th golf club head according to claim 1, wherein the face plate includes at the upper edge thereof a protrusion portion extending along a rear surface of a lower edge of the top plate.

* * * * *